US010250016B2

(12) United States Patent
Yamada et al.

(10) Patent No.: US 10,250,016 B2
(45) Date of Patent: Apr. 2, 2019

(54) IGNITION SYSTEM

(71) Applicant: NGK SPARK PLUG CO., LTD., Nagoya-shi, Aichi (JP)

(72) Inventors: Yuichi Yamada, Nagoya (JP); Kenji Ban, Nagoya (JP)

(73) Assignee: NGK SPARK PLUG CO., LTD., Nagoya-shi (JP)

( * ) Notice: Subject to any disclaimer, the term of this patent is extended or adjusted under 35 U.S.C. 154(b) by 0 days.

(21) Appl. No.: 15/461,576

(22) Filed: Mar. 17, 2017

(65) Prior Publication Data

US 2017/0279249 A1 Sep. 28, 2017

(30) Foreign Application Priority Data

Mar. 22, 2016 (JP) ..... 2016-056718

(51) Int. Cl.

| | |
|---|---|
| ***F02P 13/00*** | (2006.01) |
| ***H01T 15/00*** | (2006.01) |
| ***H01T 13/05*** | (2006.01) |
| ***H01T 13/41*** | (2006.01) |

(52) U.S. Cl.

CPC ..... *H01T 15/00* (2013.01); *F02P 13/00* (2013.01); *H01T 13/05* (2013.01); *H01T 13/41* (2013.01)

(58) Field of Classification Search

CPC . F02P 9/007; F02P 13/00; F02P 11/00; H01T 21/02; H01T 13/34; H01T 13/38; H01T 13/39; H01F 38/12

See application file for complete search history.

(56) References Cited

U.S. PATENT DOCUMENTS

| | | | | |
|---|---|---|---|---|
| 4,514,657 | A * | 4/1985 | Igashira | H01T 13/32 313/130 |
| 5,785,035 | A | 7/1998 | Mitani et al. | 123/633 |
| 8,907,552 | B2 * | 12/2014 | Katsuraya | F02P 3/01 313/118 |
| 9,169,820 | B2 * | 10/2015 | Yamada | F02P 9/007 |
| 9,287,686 | B2 * | 3/2016 | Camilli | H01T 13/40 |
| 2004/0173194 | A1 * | 9/2004 | Fuma | F02P 3/02 123/634 |
| 2008/0149083 | A1 * | 6/2008 | Katoh | F02P 9/007 123/634 |
| 2012/0260899 | A1 * | 10/2012 | Yamada | F02P 9/007 123/606 |

(Continued)

FOREIGN PATENT DOCUMENTS

| | | | |
|---|---|---|---|
| JP | H07-211433 | 8/1995 | H01T 13/05 |

*Primary Examiner* — Long T Tran
(74) *Attorney, Agent, or Firm* — Kusner & Jaffe

(57) ABSTRACT

An ignition system that uses a technique capable of restraining radiation of noise caused by discharge of a spark plug in the ignition system. The ignition system includes a spark plug and a power supply section. The spark plug is attached to an engine head. The power supply section has a battery having a ground terminal, and an ignition coil which transforms a voltage of the battery and supplies a transformed voltage to the spark plug. In the ignition system, a metallic shell of the spark plug is fixed to the engine head while being electrically insulated from the engine head through an insulator; an electrically conductive path is connected to the metallic shell; and the electrically conductive path is electrically connected to the ground terminal of the battery while being electrically insulated from the engine head.

7 Claims, 14 Drawing Sheets

(56) References Cited

U.S. PATENT DOCUMENTS

| | | | | |
|---|---|---|---|---|
| 2014/0292179 | A1* | 10/2014 | Katsuraya | F02P 3/01<br>313/141 |
| 2014/0299085 | A1* | 10/2014 | Ikeda | F02B 9/00<br>123/143 B |
| 2015/0340846 | A1* | 11/2015 | Schultz | F02P 3/0807<br>123/146.5 R |

* cited by examiner

IGNITION SYSTEM

FIELD OF THE INVENTION

The present invention relates to an ignition system.

BACKGROUND OF THE INVENTION

A vehicle driven by an internal combustion engine has an ignition system composed of a spark plug, a battery, an ignition coil, etc. In such an ignition system, a discharge of the spark plug is known to generate electromagnetic noise (see, for example, Japanese Patent Application Laid-Open (kokai) No. H07-211433).

Problem to be Solved by the Invention

Upon generation of noise as a result of discharge of the spark plug, the noise may affect various kinds of electronics mounted in the vehicle. In recent years, since the number of electronics mounted in the vehicle is increasing, such a problem becomes particularly marked. Therefore, demand has been rising for a technique capable of restraining radiation of noise caused by discharge of the spark plug in the ignition system.

SUMMARY OF THE INVENTION

Means for Solving the Problem

The present invention has been conceived to solve the above problem and can be embodied in the following modes.

(1) A first mode of the present invention provides an ignition system. The ignition system comprises a spark plug attached to an engine head; and a power supply section having a battery which has a ground terminal, and an ignition coil which transforms a voltage of the battery and supplies a transformed voltage to the spark plug. The spark plug comprises a first insulator having an axial hole; an internal electrode provided in the axial hole and having a terminal connected to the ignition coil; and a metallic shell disposed around an outer circumference of the first insulator, having a ground electrode, and fixed to the engine head. In the ignition system, the metallic shell is fixed to the engine head while being electrically insulated from the engine head through a second insulator; an electrically conductive path is connected to the metallic shell; and the electrically conductive path is electrically connected to the ground terminal while being electrically insulated from the engine head. According to the ignition system of such a mode, at the time of discharge of the spark plug, current does not flow to the engine head and flows through the electrically conductive path. As a result, a current path can be designed to reduce the loop area of current to a greater extent than in the case of flowing current through the engine head, whereby radiation of noise caused by discharge of the spark plug can be restrained. Also, since current does not flow to the engine head, the engine head does not become a source of radiation of noise, thereby restraining noise from affecting electronics mounted in a vehicle, which could otherwise result from radiation of noise from the engine head.

(2) The ignition system of the first mode may further comprise a grounded electrically conductive shield which extends from a terminal side and surrounds at least a portion of the spark plug. According to the ignition system of such a mode, the electrically conductive path and the shield can more effectively restrain radiation of noise caused by discharge of the spark plug.

(3) A second mode of the present invention provides an ignition system. The ignition system comprises a spark plug attached to an engine head; and a power supply section having a battery which has a ground terminal, and an ignition coil which transforms a voltage of the battery and supplies a transformed voltage to the spark plug. The spark plug comprises a first insulator having an axial hole; an internal electrode provided in the axial hole and having a terminal connected to the ignition coil; and a metallic shell disposed around an outer circumference of the first insulator, having a ground electrode, and fixed to the engine head. The ignition system further comprises an electrically conductive shield which extends from a terminal side and surrounds at least a portion of the spark plug, and the shield is electrically connected to the ground terminal while being electrically insulated from the engine head. Generally, since the engine head is located near the position of discharge of the spark plug, a relatively large noise is generated in the engine head. If the shield which covers the spark plug is connected to such an engine head, noise may transfer from the engine head to the shield; as a result, the shield may become a source of radiation of noise. However, according to the ignition system of the second mode, the shield which covers the spark plug is electrically insulated from the engine head and is electrically connected to the ground terminal of the battery located by a relatively long distance from the position of discharge of the spark plug. Therefore, even though noise is generated in the engine head, transfer of the noise to the shield is restrained, whereby the shield can effectively restrain radiation of noise caused by discharge of the spark plug. As a result, noise can be restrained from affecting electronics mounted in a vehicle.

(4) in the ignition system of any one of the above modes, the resistance of the internal electrode may be 1Ω or less. The ignition system of such a mode can more effectively restrain radiation of noise caused by discharge of the spark plug.

(5) In the ignition system of any one of the above modes, the power supply section may further have an AC power source for applying an AC power to the internal electrode. The ignition system of such a mode can more effectively restrain radiation of noise caused by discharge of the spark plug.

The present invention can be embodied in various forms other than the ignition system mentioned above. For example, the present invention can be embodied in a control method for an ignition system and an attachment structure for a spark plug.

DETAILED DESCRIPTION

A. First Embodiment

Figure 1:
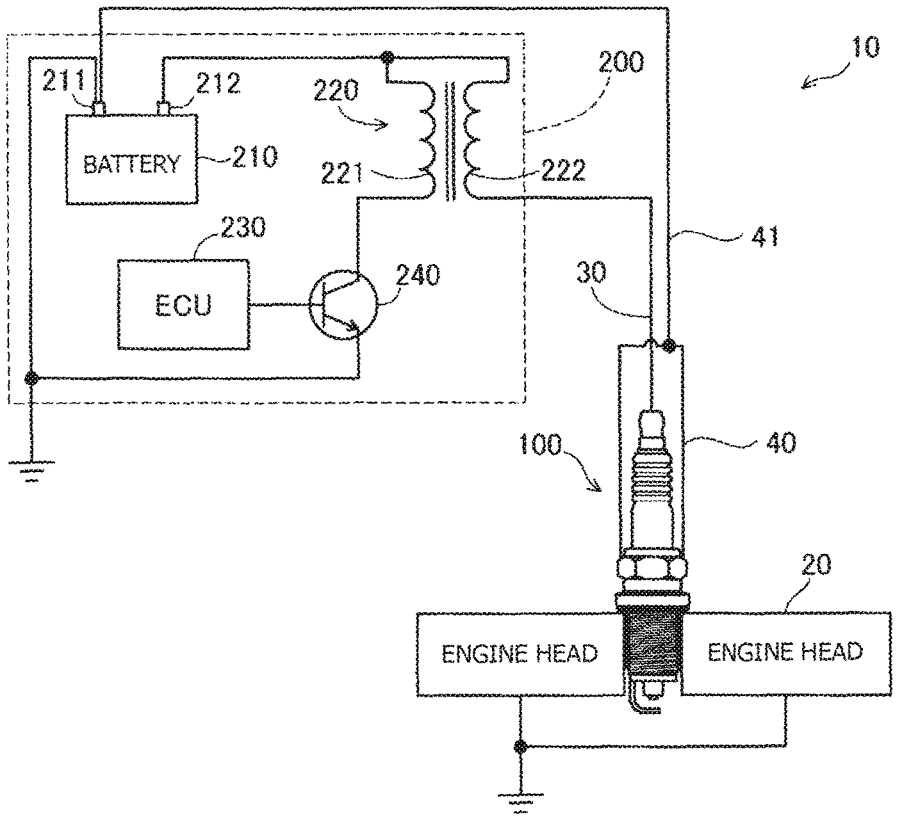
FIG. 1 is a diagram showing a schematic configuration of an ignition system according to a first embodiment of the present invention.

FIG. 1 is a diagram showing a schematic configuration of an ignition system 10 according to a first embodiment of the present invention. The ignition system 10 is adapted to ignite an air-fuel mixture in an internal combustion engine mounted in a vehicle. The ignition system 10 includes a spark plug 100 attached to an engine head 20, and a power supply section 200.

The power supply section 200 includes a battery 210 and an ignition coil 220. The ignition coil 220 includes a primary coil 221 and a secondary coil 222, and the secondary coil 222 is connected to the spark plug 100 by means of a plug cord 30. The battery 210 includes a ground terminal 211 and a power supply terminal 212. The ignition coil 220 transforms a voltage applied from the power supply terminal 212 of the battery 210 to the primary coil 221 to a high voltage and supplies the high voltage from the secondary coil 222 to the spark plug 100. An electronic control unit (ECU) 230 performs on/off control of an igniter 240 connected to the primary coil 221 of the ignition coil 220, thereby controlling the ignition timing of the spark plug 100, i.e., the timing of application of the high voltage from the ignition coil 220 to the spark plug 100. As shown in FIG. 1, the ground terminal 211 of the battery 210 and the engine head 20 are grounded (body-earthed).

Figure 2:
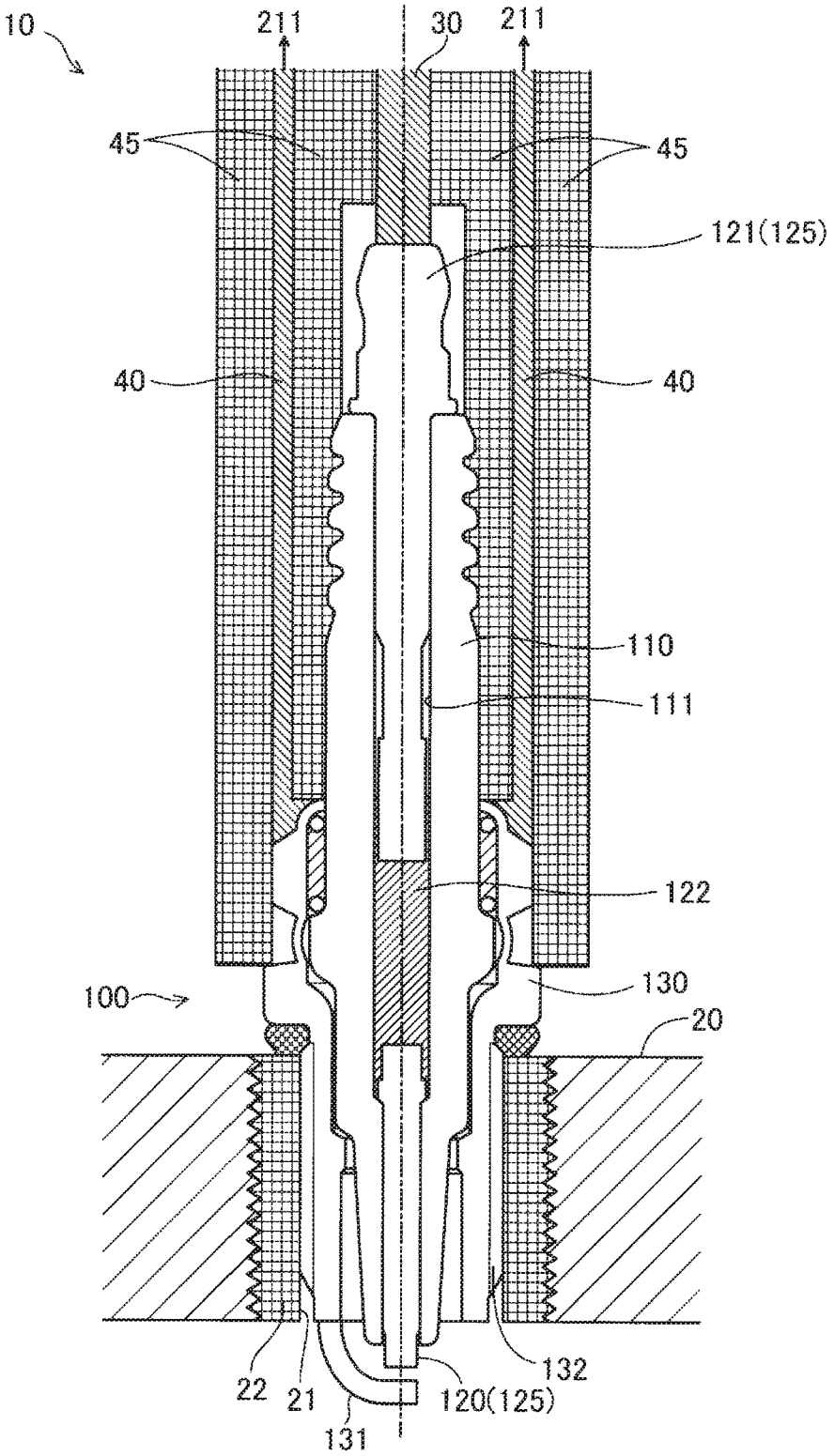
FIG. 2 is a sectional view showing an attachment structure for the spark plug of the first embodiment.

FIG. 2 is a sectional view showing an attachment structure for the spark plug 100 in the first embodiment. The spark plug 100 includes a first insulator 110, a center electrode 120, and a metallic shell 130.

The first insulator 110 is a tubular ceramic insulator having an axial hole 111 at the center. The first insulator 110 is formed from, for example, a ceramic material such as alumina by firing. The rodlike center electrode 120 is inserted into the axial hole 111 from the forward end side. The center electrode 120 is formed such that a core metal of copper or a copper alloy is embedded in an electrode base metal of a nickel alloy. A terminal 121 connected to the ignition coil 220 is provided at the rear end side of the axial hole 111. The center electrode 120 is electrically connected within the axial hole 111 to the terminal 121 through a seal material 122. In the present embodiment, the center electrode 120 and the terminal 121 are collectively called an internal electrode 125. That is, in the present embodiment, the internal electrode 125 has the terminal 121. The resistance of the internal electrode 125; more specifically, the resistance between the center electrode 120 and the terminal 121, is variable according to the seal material 122.

The metallic shell 130 is a tubular metallic member disposed around the outer circumference of the first insulator 110 and has a ground electrode 131 at its forward end. The metallic shell 130 is formed of, for example, low-carbon steel. The metallic shell 130 and the center electrode 120 are electrically insulated from each other with the first insulator 110. The ground electrode 131 forms a gap for discharge in cooperation with the center electrode 120. The ground electrode 131 is formed of, for example, a nickel alloy.

The metallic shell 130 externally has a mounting threaded portion 132 at its forward end portion. The mounting threaded portion 132 has an external thread formed thereon. The external thread of the mounting threaded portion 132 is threadingly engaged with an internal thread formed in a plug attachment hole 21 of the engine head 20, whereby the metallic shell 130 is fixed to the engine head 20.

In the present embodiment, the plug attachment hole 21 is formed in a second insulator 22 embedded in the engine head 20. Thus, in the present embodiment, the metallic shell 130 is fixed to the engine head 20 while being electrically insulated from the engine head 20 through the second insulator 22. The second insulator 22 is formed from, for example, a ceramic material by firing.

In the present embodiment, an electrically conductive path 40 is connected to the metallic shell 130. The electrically conductive path 40 is electrically insulated from the engine head 20. The electrically conductive path 40 is electrically connected to the ground terminal 211 of the battery 210 through a cable 41 (FIG. 1). The electrically conductive path 40 is circumferentially covered with inner and outer insulation layers 45 of resin (e.g., silicone resin) so as not to come into contact with the terminal 121 and the engine head 20. The electrically conductive path 40 can be formed of, for example, a cylindrical pipe of SUS.

In the above-described ignition system 10 of the first embodiment, the metallic shell 130 of the spark plug 100 and the engine head 20 are electrically insulated from each other by the second insulator 22, and the metallic shell 130 (the ground electrode 131) is connected directly to the ground terminal 211 of the battery 210 through the electrically conductive path 40 without involving the engine head 20. Thus, at the time of discharge of the spark plug 100, current does not flow to the engine head 20 and flows through the electrically conductive path 40 and the cable 41. As a result, a current path can be designed to reduce the loop area of current to a greater extent than in the case of flowing current through the engine head 20, whereby radiation of noise caused by discharge of the spark plug 100 can be effectively restrained. Furthermore, according to the present embodiment, since current does not flow to the engine head 20 at the time of discharge of the spark plug 100, the engine head 20 does not become a source of radiation of noise, thereby restraining noise from affecting electronics mounted in a vehicle, which could otherwise result from radiation of noise from the engine head 20.

Figure 3:
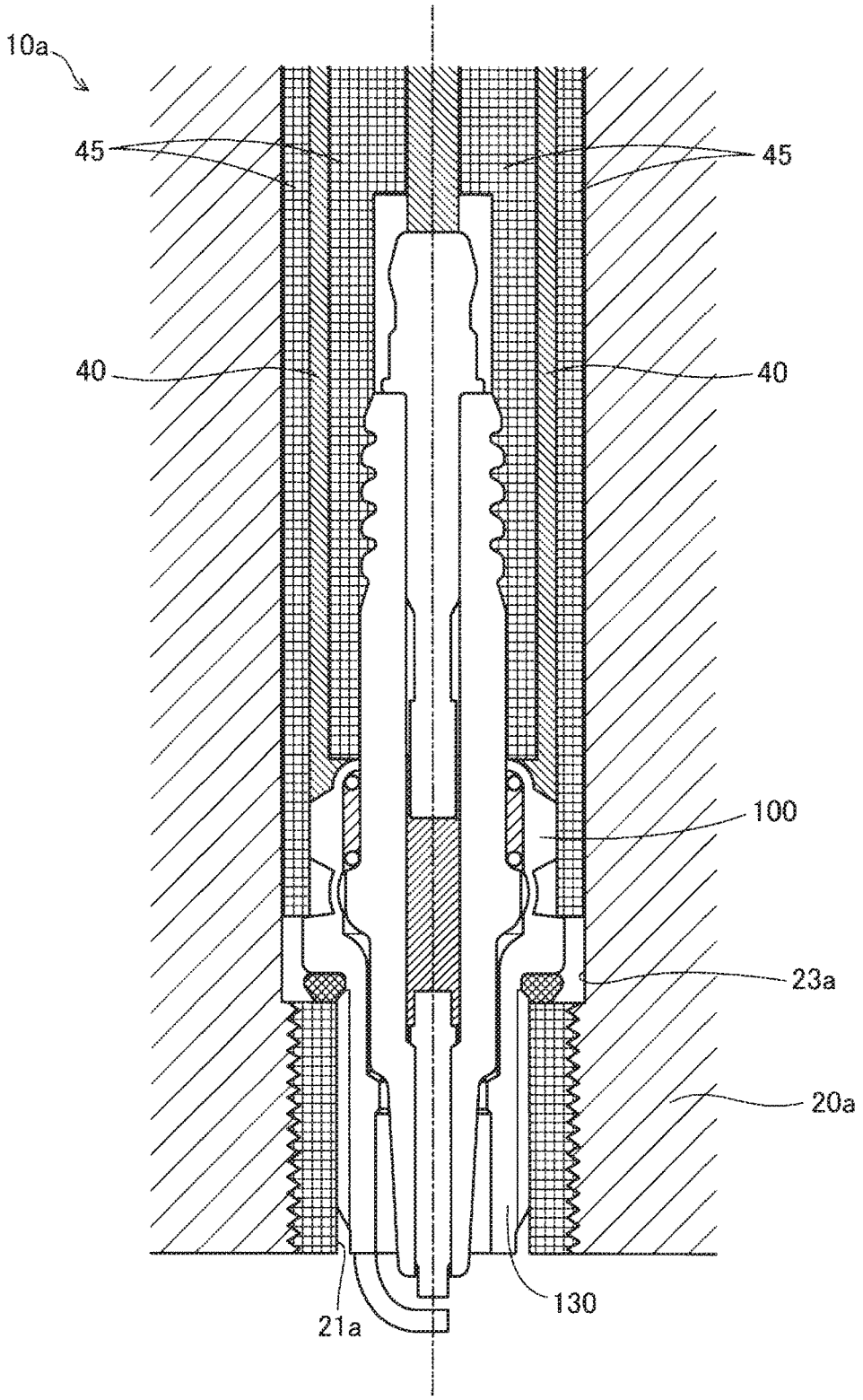
FIG. 3 is a sectional view showing an ignition system according to a modification of the first embodiment.

FIG. 3 is a sectional view showing an ignition system 10*a* according to a modification of the first embodiment. The engine head 20 shown in FIG. 2 is such that a portion to which the spark plug 100 is attached is flat, whereas, in the present modification, an engine head 20*a* has a plug hole 23*a* into which the spark plug 100 is inserted. The metallic shell 130 of the spark plug 100 is fixed to a plug attachment hole 21*a* formed in a bottom portion of the plug hole 23*a*. The electrically conductive path 40 and the insulation layers 45 are disposed within the plug hole 23*a*. The configuration of the ignition system 10*a* of the present modification is similar to that of the first embodiment except that the engine head 20*a* has the plug hole 23*a*. According to the present modification, since the spark plug 100 is circumferentially covered with the engine head 20*a*, radiation of noise can be more effectively restrained.

B. Second Embodiment

Figure 4:
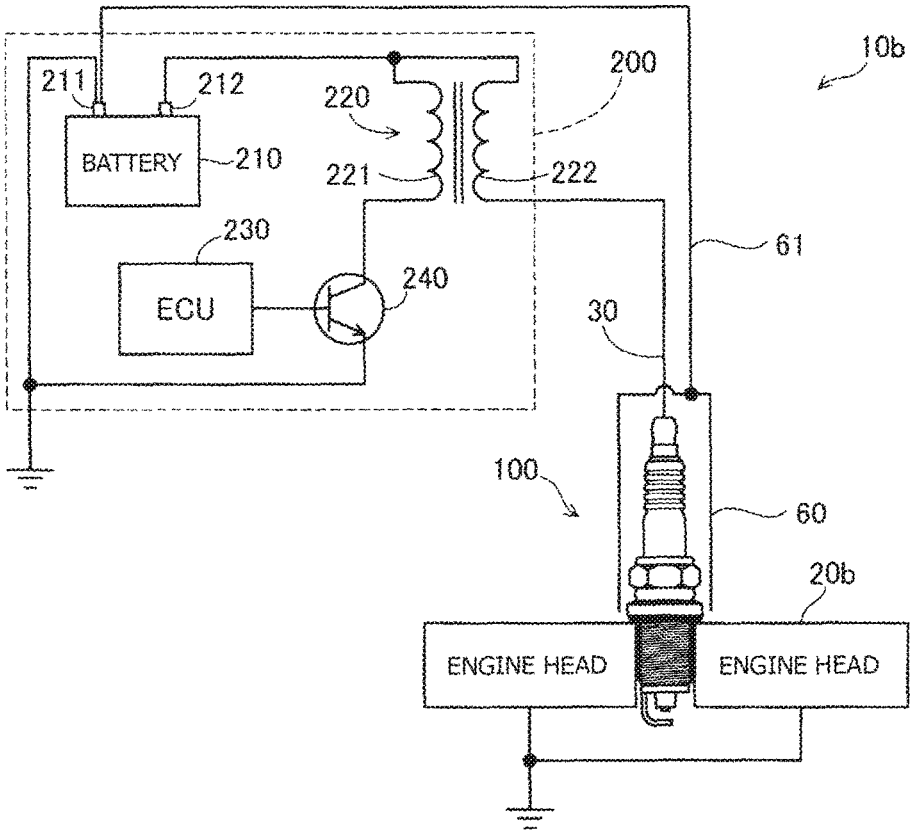
FIG. 4 is a diagram showing a schematic configuration of an ignition system according to a second embodiment of the present invention.

FIG. 4 is a diagram showing a schematic configuration of an ignition system 10*b* according to a second embodiment of the present invention. In the ignition system 10*b* of the present embodiment, the attachment structure for the spark plug 100 differs from that of the first embodiment, whereas the configurations of the spark plug 100 and the power supply section 200 are similar to those of the first embodiment. As shown in FIG. 4, in the present embodiment, the spark plug 100 is circumferentially covered with a shield 60. The shield 60 is electrically connected to the ground terminal 211 of the battery 210 through a cable 61.

Figure 5:
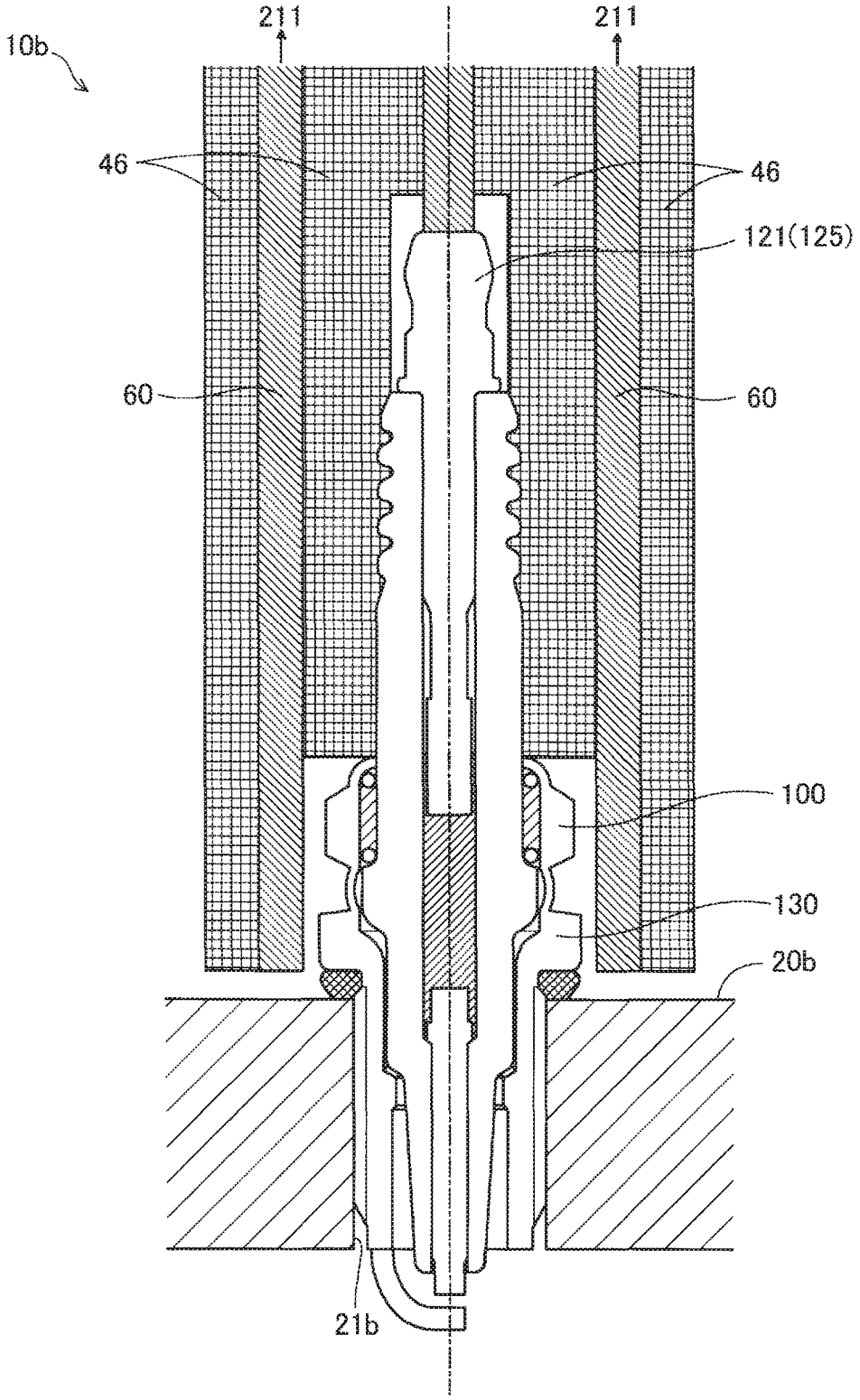
FIG. 5 is a sectional view showing an attachment structure for the spark plug of the second embodiment.

FIG. 5 is a sectional view showing an attachment structure for the spark plug 100 of the second embodiment. As shown in FIG. 5, in contrast to the first embodiment, in the present embodiment, the second insulator 22 (FIG. 2) is not provided in an engine head 20*b*. Accordingly, the metallic shell 130 of the spark plug 100 is fixed to a plug attachment hole 21*b* without being electrically insulated from the engine head 20*b*.

In the present embodiment, the ignition system 10*b* further includes the electrically conductive cylindrical shield 60 which extends from a terminal 121 side and surrounds at least a portion of the spark plug 100 (more specifically, the metallic shell 130). The shield 60 is disposed apart from the engine head 20*b*. That is, the shield 60 is electrically insulated from the engine head 20*b*. The shield 60 is electrically connected to the ground terminal 211 of the battery 210 through the cable 61 (FIG. 4). The shield 60 is circumferentially covered with inner and outer insulation layers 46 of resin (e.g., silicone resin) so as not to come into contact with the terminal 121, the metallic shell 130, and the engine head 20*b*. The shield 60 can be formed of, for example, a cylindrical pipe of SUS.

The above-described ignition system 10*b* of the second embodiment includes the electrically conductive shield 60 which extends from the terminal 121 side and surrounds at least a portion of the spark plug 100. The shield 60 is electrically insulated from the engine head 20*b* and electrically connected to the ground terminal 211 of the battery 210. Generally, since the engine head 20 is located near the position of discharge of the spark plug 100, a relatively large noise is generated in the engine head 20. If the shield 60 which covers the spark plug 100 is connected to such the engine head 20, noise may transfer from the engine head 20 to the shield 60; as a result, the shield 60 may become a source of radiation of noise. However, according to the ignition system 10*b* of the present embodiment, the shield 60 which covers the spark plug 100 is electrically insulated from the engine head 20 and is electrically connected to the ground terminal 211 of the battery 210 located by a relatively long distance from the position of discharge of the spark plug 100. Therefore, even though noise is generated in the engine head 20, transfer of the noise to the shield 60 is restrained, whereby the shield 60 can effectively restrain radiation of noise caused by discharge of the spark plug 100. As a result, noise can be restrained from affecting electronics mounted in a vehicle.

Figure 6:
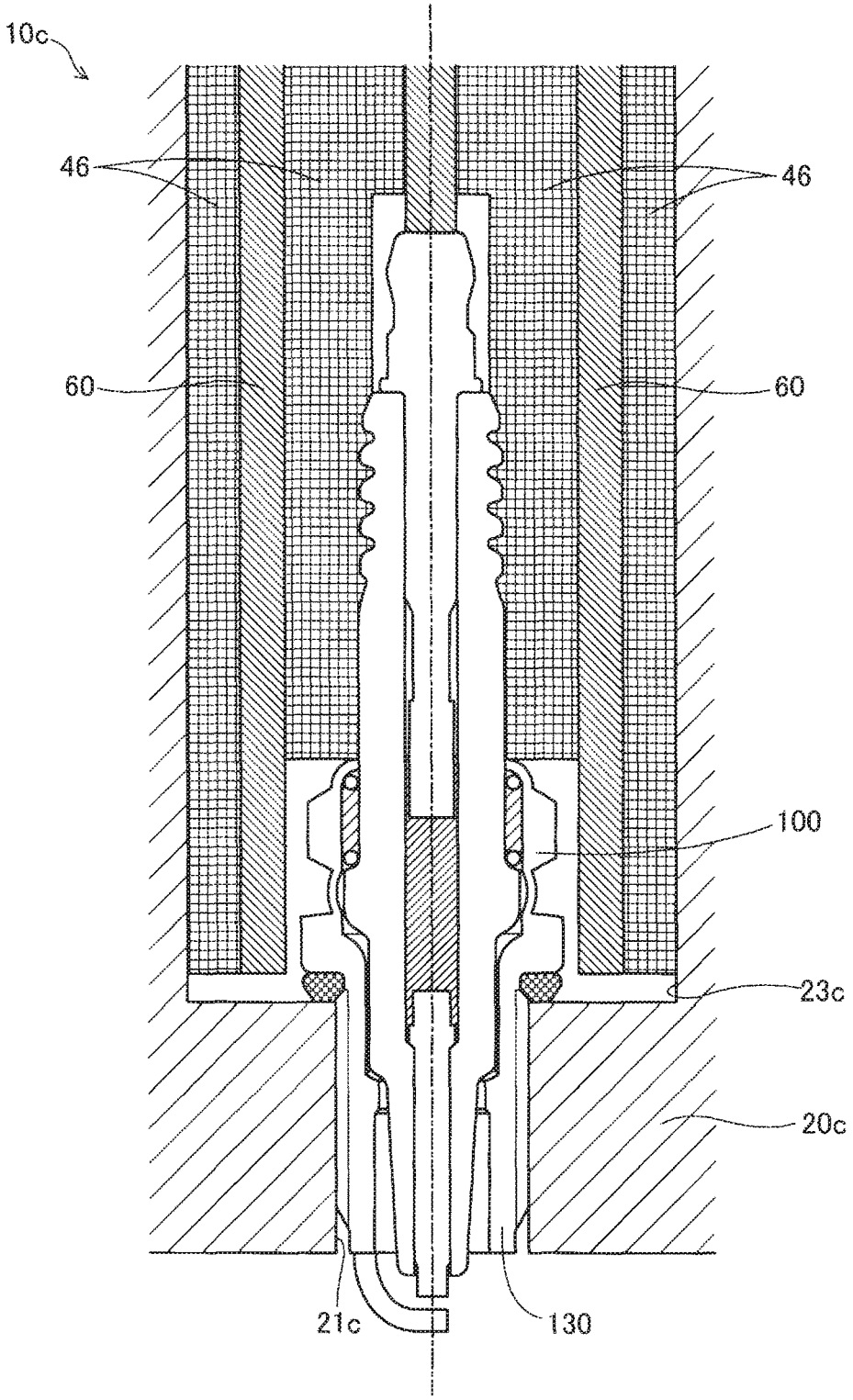
FIG. 6 is a sectional view showing an ignition system according to a modification of the second embodiment.

FIG. 6 is a sectional view showing an ignition system 10*c* according to a modification of the second embodiment. The engine head 20*b* shown in FIG. 5 is such that a portion to which the spark plug 100 is attached is flat, whereas, in the present modification, an engine head 20*c* has a plug hole 23*c* into which the spark plug 100 is inserted. The metallic shell 130 of the spark plug 100 is fixed to a plug attachment hole 21*c* formed in a bottom portion of the plug hole 23*c*. The shield 60 and the insulation layers 46 are disposed within the plug hole 23*c*. The configuration of the ignition system 10*c* of the present modification is similar to that of the second embodiment except that the engine head 20*c* has the plug hole 23*c*. According to the present modification, since the spark plug 100 is circumferentially covered with the engine head 20*c*, radiation of noise can be more effectively restrained.

C. Third Embodiment

Figure 7:
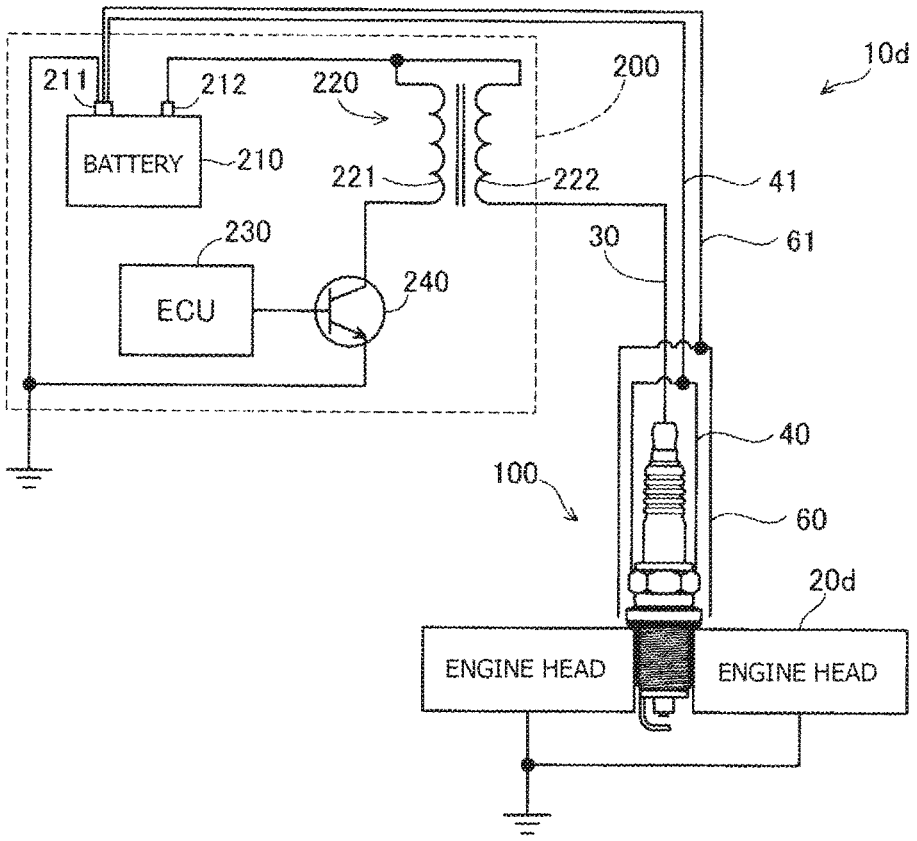
FIG. 7 is a diagram showing a schematic configuration of an ignition system according to a third embodiment of the present invention.

FIG. 7 is a diagram showing a schematic configuration of an ignition system 10*d* according to a third embodiment of the present invention. In the ignition system 10*d*, the attachment structure of the spark plug 100 differs from those of the first and second embodiments, whereas the configurations of the spark plug 100 and the power supply section 200 are similar to those of the first and second embodiments. As shown in FIG. 7, in the present embodiment, similar to the second embodiment, the spark plug 100 is circumferentially covered with the shield 60, and the shield 60 is electrically connected to the ground terminal 211 of the battery 210 through the cable 61. Also, in the present embodiment, similar to the first embodiment, the electrically conductive path 40 is connected to the metallic shell 130 of the spark plug 100, and the electrically conductive path 40 is electrically connected to the ground terminal 211 of the battery 210 through the cable 41.

Figure 8:
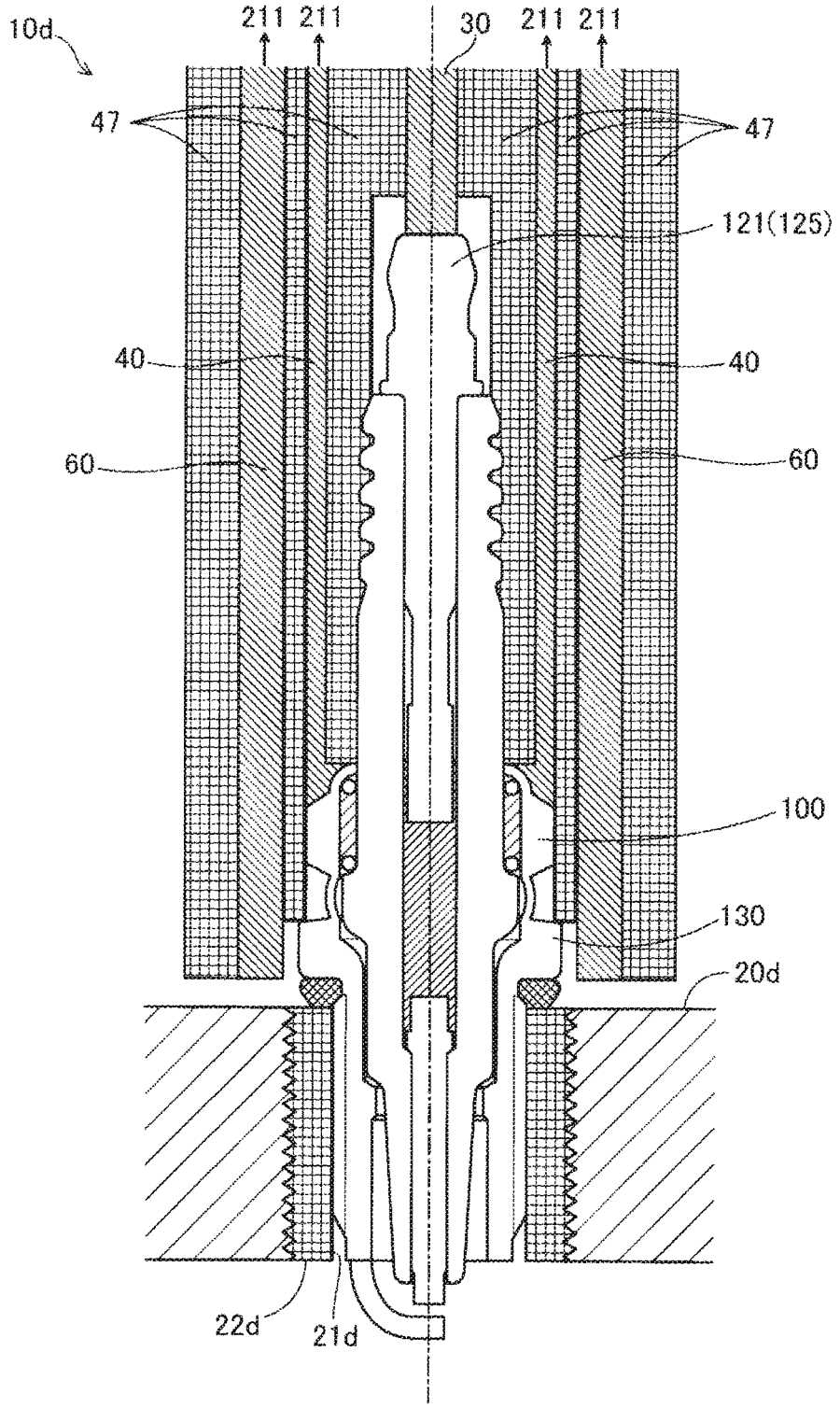
FIG. 8 is a sectional view showing an attachment structure for the spark plug of the third embodiment.

FIG. 8 is a sectional view showing an attachment structure for the spark plug 100 in the third embodiment. As shown in FIG. 8, in the present embodiment, similar to the first embodiment, the electrically conductive path 40 is connected to the metallic shell 130. The electrically conductive path 40 is electrically connected to the ground terminal 211 of the battery 210 through the cable 41 (FIG. 7). The electrically conductive path 40 is circumferentially covered with inner and outer insulation layers 47 of resin (e.g., silicone resin) so as not to come into contact with the terminal 121 and the shield 60.

In the present embodiment, similar to the first embodiment, a second insulator 22*d* is provided in an engine head 20*d*, and a plug attachment hole 21*d* is formed in the second insulator 22*d*. Thus, the metallic shell 130 of the spark plug 100 is fixed to the engine head 20*d* while being electrically insulated from the engine head 20*d* through the second insulator 22*d*.

Further, in the present embodiment, similar to the second embodiment, the ignition system 10*d* further includes the electrically conductive cylindrical shield 60 which extends from the terminal 121 side and surrounds at least a portion of the spark plug 100 (more specifically, the metallic shell 130). The shield 60 is disposed around the outer circumference of the electrically conductive path 40. The shield 60 is disposed apart from the engine head 20*d*. That is, the shield 60 is electrically insulated from the engine head 20*d*. The shield 60 is electrically connected to the ground terminal 211 of the battery 210 through the cable 61 (FIG. 7). The shield 60 is circumferentially covered with the inner and outer insulation layers 47 of resin so as not to come into contact with the terminal 121, the metallic shell 130, the engine head 20*d*, and the electrically conductive path 40. Similar to the first and second embodiments, the electrically conductive path 40 and the shield 60 can be formed of, for example, respective cylindrical pipes of SUS.

In the above-described ignition system 10*d* of the third embodiment, similar to the first embodiment, the metallic shell 130 is electrically insulated from the engine head 20*d* and is connected to the ground terminal 211 of the battery 210 by means of the electrically conductive path 40. Further, in the present embodiment, the shield 60 connected to the ground terminal 211 of the battery 210 surrounds at least a portion of the spark plug 100. Thus, radiation of noise caused by discharge of the spark plug 100 can be more effectively restrained by means of the electrically conductive path 40 and the shield 60.

Figure 9:
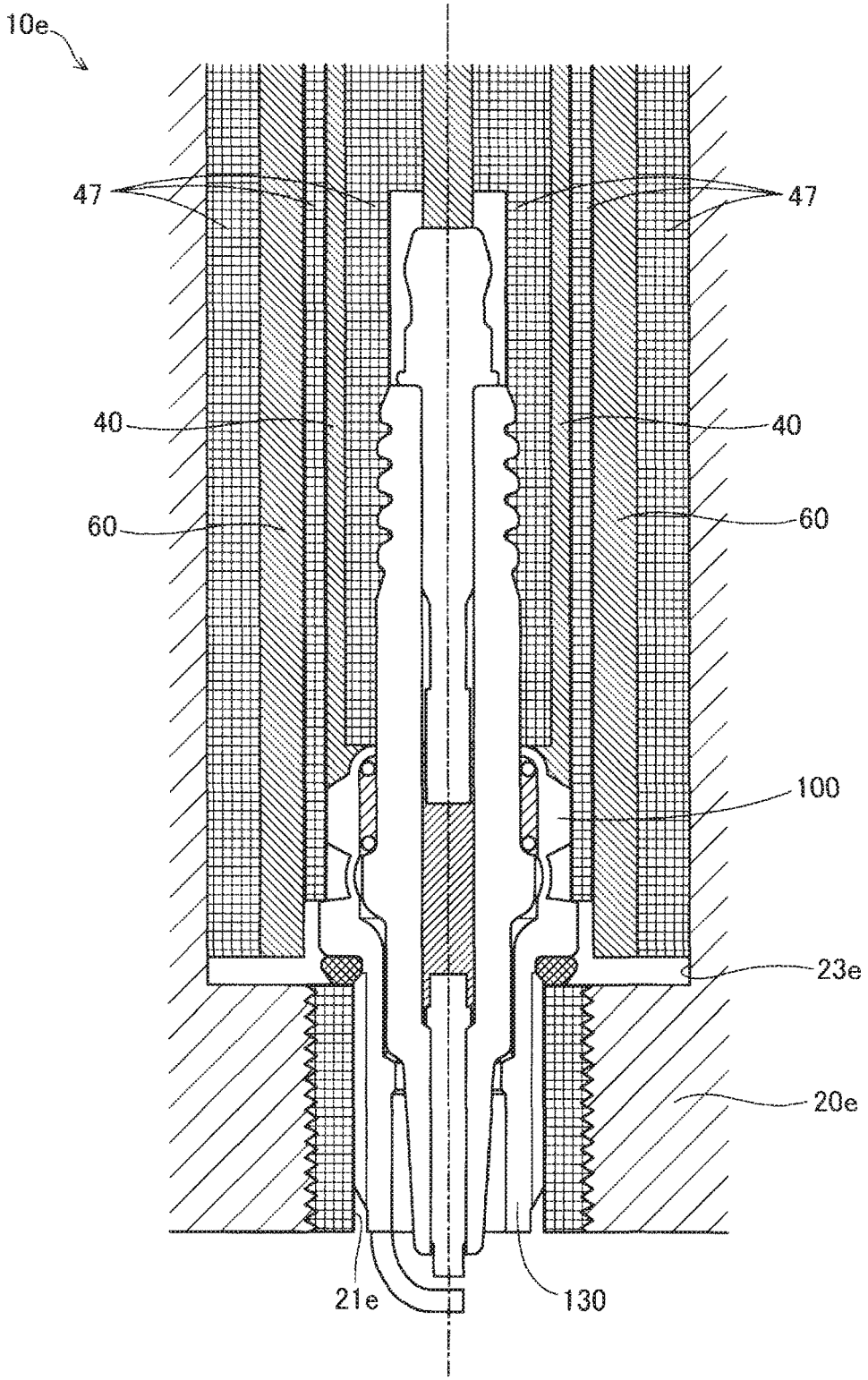
FIG. 9 is a sectional view showing an ignition system according to a modification of the third embodiment.

FIG. 9 is a sectional view showing an ignition system 10*e* according to a modification of the third embodiment. The engine head 20*d* shown in FIG. 8 is such that a portion to which the spark plug 100 is attached is flat, whereas, in the present modification, an engine head 20*e* has a plug hole 23*e* into which the spark plug 100 is inserted. The metallic shell 130 of the spark plug 100 is fixed to a plug attachment hole 21*e* formed in a bottom portion of the plug hole 23*e*. The electrically conductive path 40, the shield 60, and the insulation layers 47 are disposed within the plug hole 23*e*. The configuration of the ignition system 10*e* of the present modification is similar to that of the third embodiment except that the engine head 20*e* has the plug hole 23*e*. According to the present modification, since the spark plug 100 is circumferentially covered with the engine head 20*d*, radiation of noise can be more effectively restrained.

According to the above-described third embodiment, the shield 60 is electrically connected to the ground terminal 211 of the battery 210 and is electrically insulated from the engine head 20*d*. By contrast, the shield 60 may be electrically connected to the engine head 20*d*. In this case, the shield 60 may be electrically insulated from the ground terminal 211 of the battery 210. This is for the following reason: according to the third embodiment, the metallic shell 130 and the engine head 20*d* are electrically insulated from each other by means of the second insulator 22*d*, and thus current does not flow to the engine head 20*d* at the time of discharge of the spark plug 100; therefore, even though the shield 60 is grounded to the engine head 20*d*, noise radiated from the spark plug 100 can be effectively restrained. That is, according to the third embodiment, if the shield 60 is grounded to any part of a vehicle, the shield 60 can restrain radiation of noise caused by discharge of the spark plug 100.

D. Evaluation Tests

Figure 10:
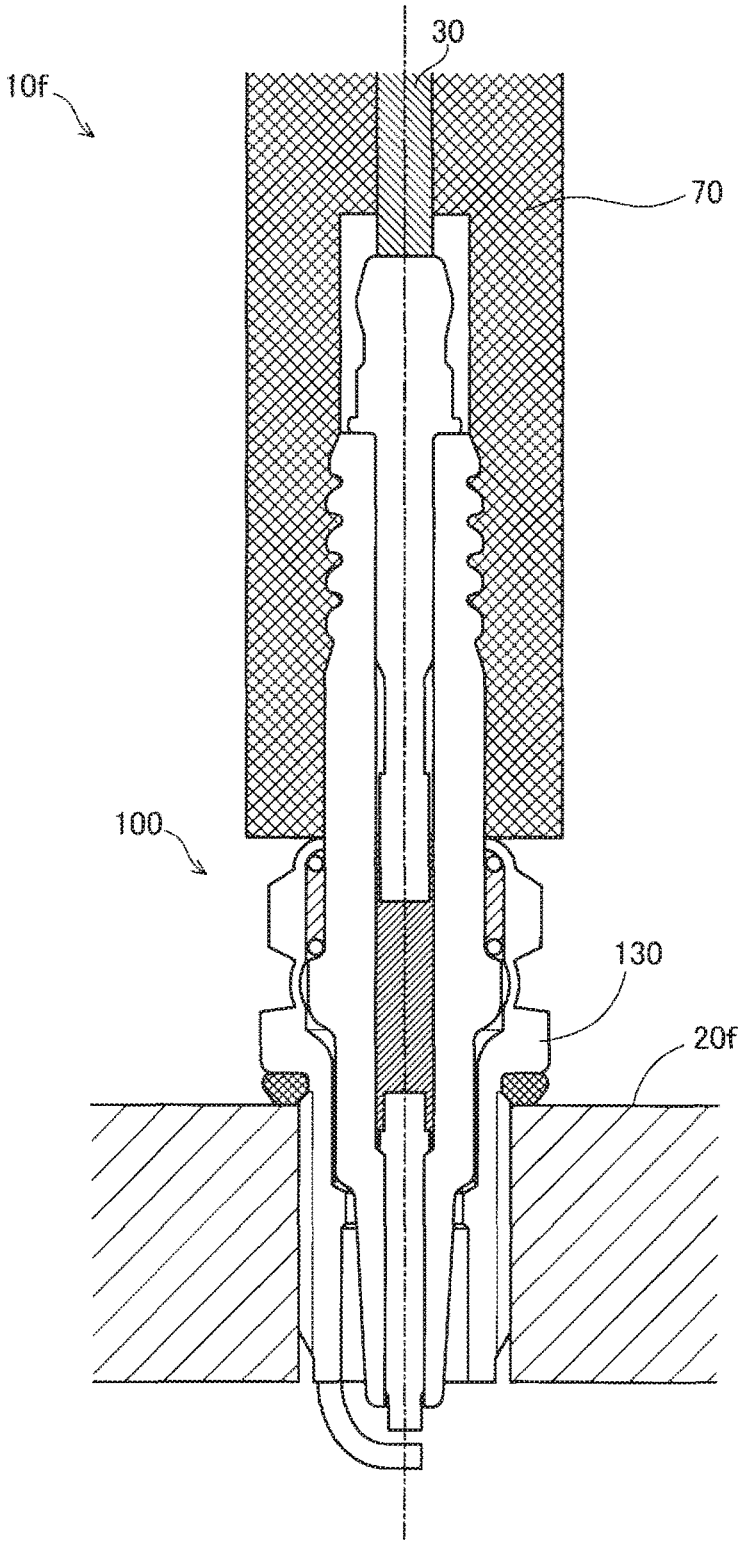
FIG. 10 is a sectional view showing an ignition system of a comparative example.

FIG. 10 is a sectional view showing an ignition system 10*f* of a comparative example which is used in an evaluation test which will be described below. In the ignition system 10*f* of the comparative example, the configurations of the spark plug 100 and the power supply section 200 are similar to those of the first to third embodiments. In the comparative example, the second insulator 22 is not provided in an engine head 20*f*. Thus, the metallic shell 130 of the spark plug 100 is fixed to the engine head 20*f* without being electrically insulated from the engine head 20*f*. Also, the electrically conductive path 40 and the shield 60 mentioned in the first to third embodiments are not provided, and only the plug cord 30 is connected to the spark plug 100 through a coil boot 70. That is, according to the comparative example, the spark plug 100 is attached to the engine head 20*f* by use of a generally employed attachment structure.

Figure 11:
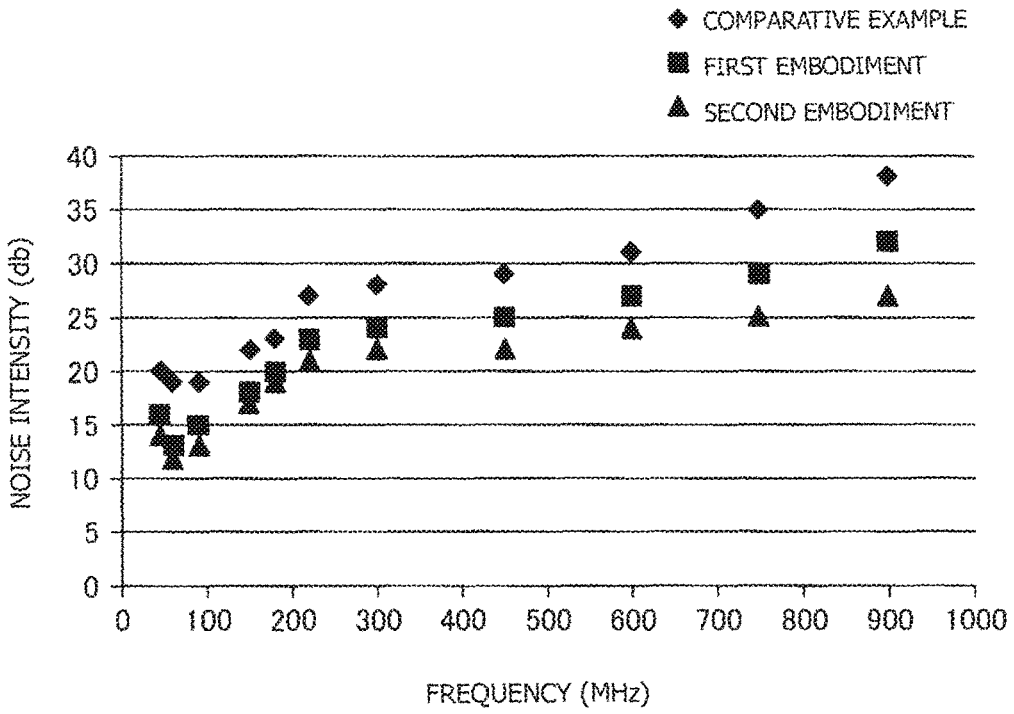
FIG. 11 is a graph showing the results of a first evaluation test.

FIG. 11 is a graph showing the results of a first evaluation test. In the first evaluation test, the ignition systems 10, 10*b*, and 10*f* of the first embodiment, the second embodiment, and the comparative example were mounted on single cylinder 27 cc 2-stroke engines, respectively, and noise intensity was measured at predetermined frequencies in accordance with the CISPR Standard Pub. 12 (5th). The spark plugs 100 of the first embodiment, the second embodiment, and the comparative example had a nominal diameter of the mounting threaded portion 132 of M14 and a resistance of the internal electrode 125 of 5 kΩ. Also, 20-cm no-resistance plug cords 30 were used to connect the terminals 121 of the spark plugs 100 and the ignition coils 220. Herein, the term "no-resistance" means a resistance of 1Ω or less.

Figure 12:
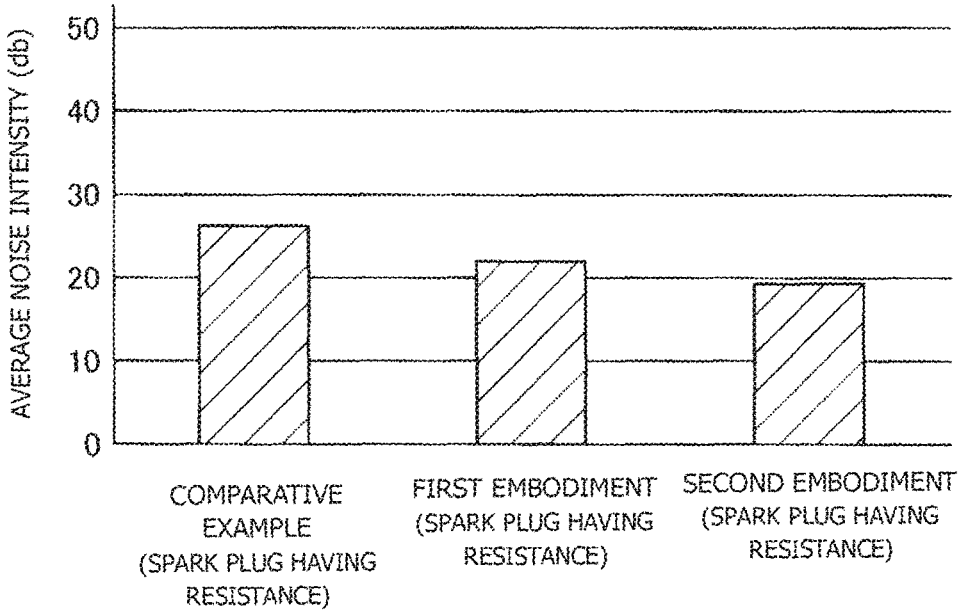
FIG. 12 is a graph showing the results of averaging of the test results of FIG. 11.

FIG. 12 is a graph showing the results of averaging of the test results of FIG. 11. Specifically, FIG. 12 shows average noise intensities at predetermined frequencies with respect to the comparative example, the first embodiment, and the second embodiment.

As shown in FIGS. 11 and 12, according to the results of the first evaluation test, the first embodiment is lower in noise intensity than the comparative example, and the second embodiment is lower in noise intensity than the first embodiment. Thus, it has been confirmed that the ignition systems 10 and 10*b* of the first and second embodiments, respectively, can restrain radiation of noise caused by discharge of the spark plug 100 as compared with the comparative example which employs the general attachment structure for the spark plug 100.

Figure 13:
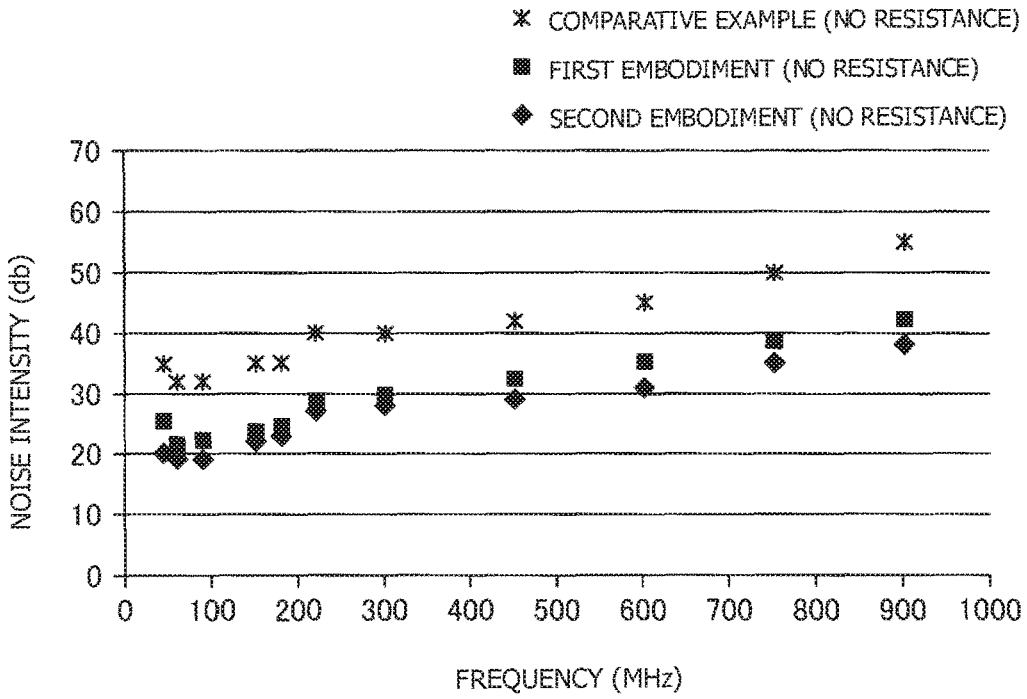
FIG. 13 is a graph showing the results of a second evaluation test.
Figure 14:
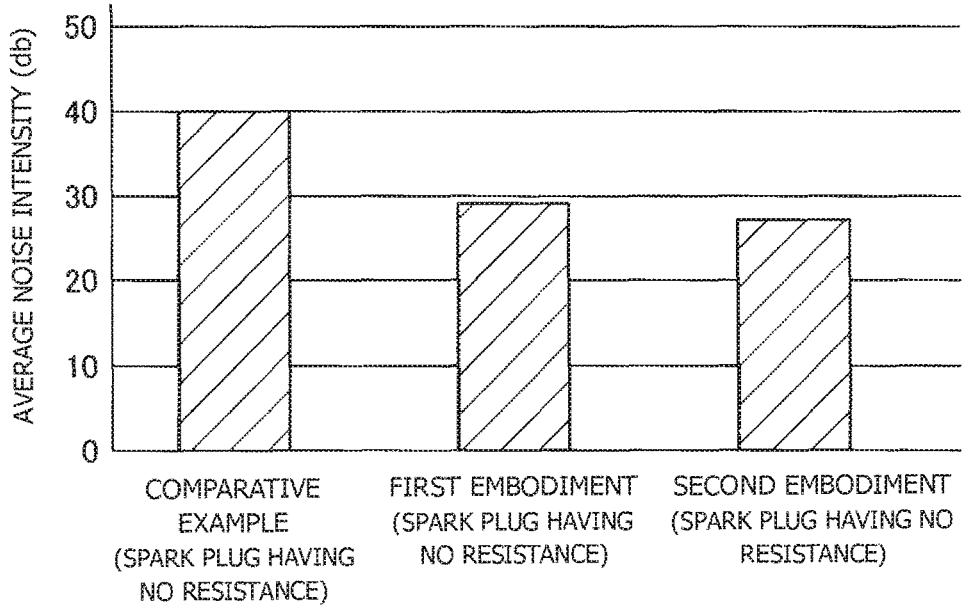
FIG. 14 is a graph showing the results of averaging of the test results of FIG. 13.

FIG. 13 is a graph showing the results of a second evaluation test. FIG. 14 is a graph showing the results of averaging of the test results of FIG. 13. The second evaluation test was performed similarly to the first evaluation test by use of the ignition systems 10, 10*b*, and 10*f* of the first embodiment, the second embodiment, and the comparative example, respectively, which employed the no-resistance spark plugs 100; i.e., the spark plugs 100 having a resistance of the internal electrode 125 of 1Ω or less.

As shown in FIGS. 13 and 14, according to the results of the second evaluation test, the no-resistance spark plugs 100 of the first embodiment and the second embodiment are higher in percentage of noise reduction from the comparative example than are the spark plugs 100 having a resistance of 5 kΩ used in the first evaluation test. Specifically, as shown in FIG. 12, according to the results of the first evaluation test which used the spark plugs 100 having a resistance, the average noise intensity is improved from about 26 db of the comparative example to about 22 db of the first embodiment and to about 19 db of the second embodiment; thus, the percentages of noise reduction are about 15% in the first embodiment and about 27% in the second embodiment. By contrast, according to the results of the second evaluation test which used the no-resistance spark plugs 100, as shown in FIG. 14, the average noise intensity is improved from about 40 db of the comparative example to about 29 db of the first embodiment and to about 27 db of the second embodiment; thus, the percentages of noise reduction are about 27% in the first embodiment and about 32% in the second embodiment. Thus, it has been confirmed that, in spite of use of the no-resistance spark plug 100 which is apt to radiate noise, the ignition systems 10 and 10*b* of the first embodiment and the second embodiment, respectively, can more effectively restrain radiation of noise.

Figure 15:
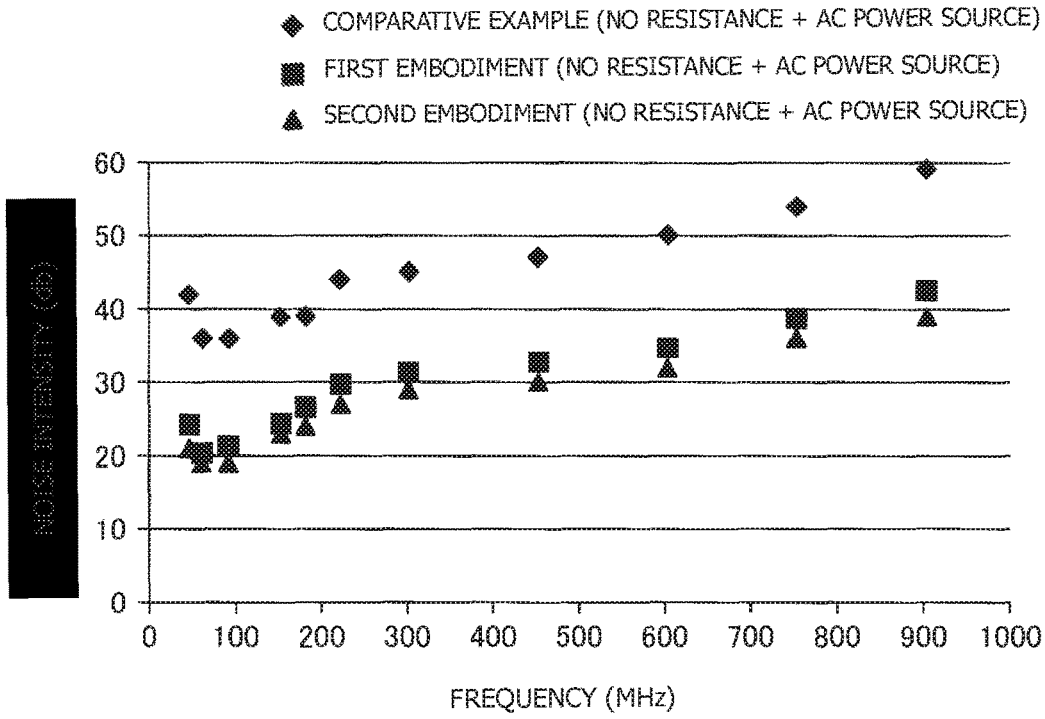
FIG. 15 is a graph showing the results of a third evaluation test.
Figure 16:
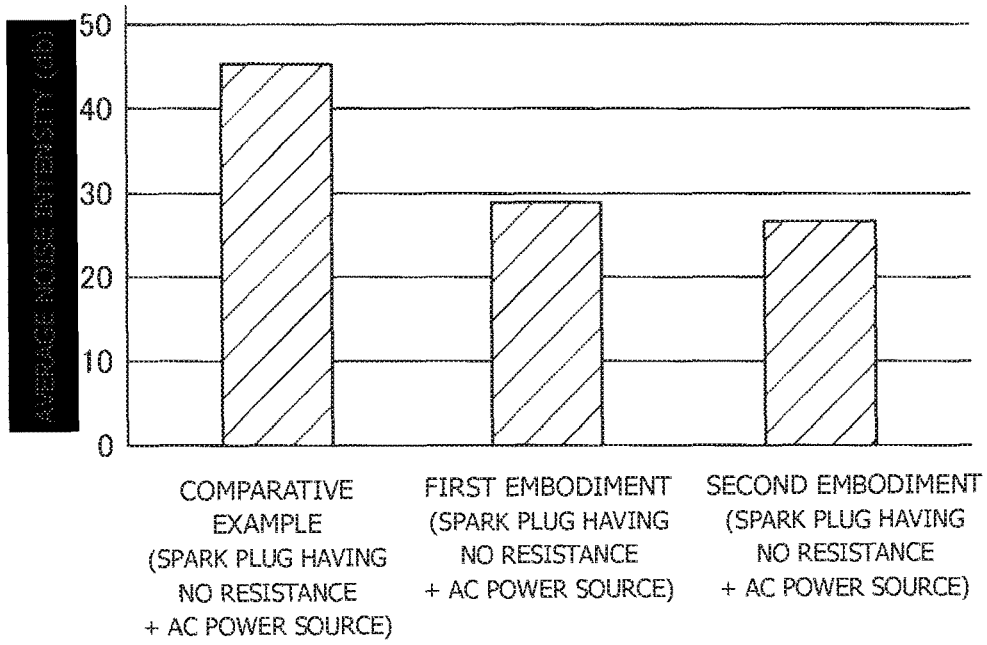
FIG. 16 is a graph showing the results of averaging of the test results of FIG. 15.

FIG. 15 is a graph showing the results of a third evaluation test. FIG. 16 is a graph showing the results of averaging of the test results of FIG. 15. Similar to the second evaluation test, the third evaluation test was performed similarly to the first evaluation test by use of the ignition systems 10, 10*b*, and 10*f* of the first embodiment, the second embodiment, and the comparative example, respectively, which employed the no-resistance spark plugs 100. However, in the present test, the configuration of the power supply section 200 was modified with respect to the ignition systems 10, 10*b*, and 10*f* of the first embodiment, the second embodiment, and the comparative example, respectively.

Figure 17:
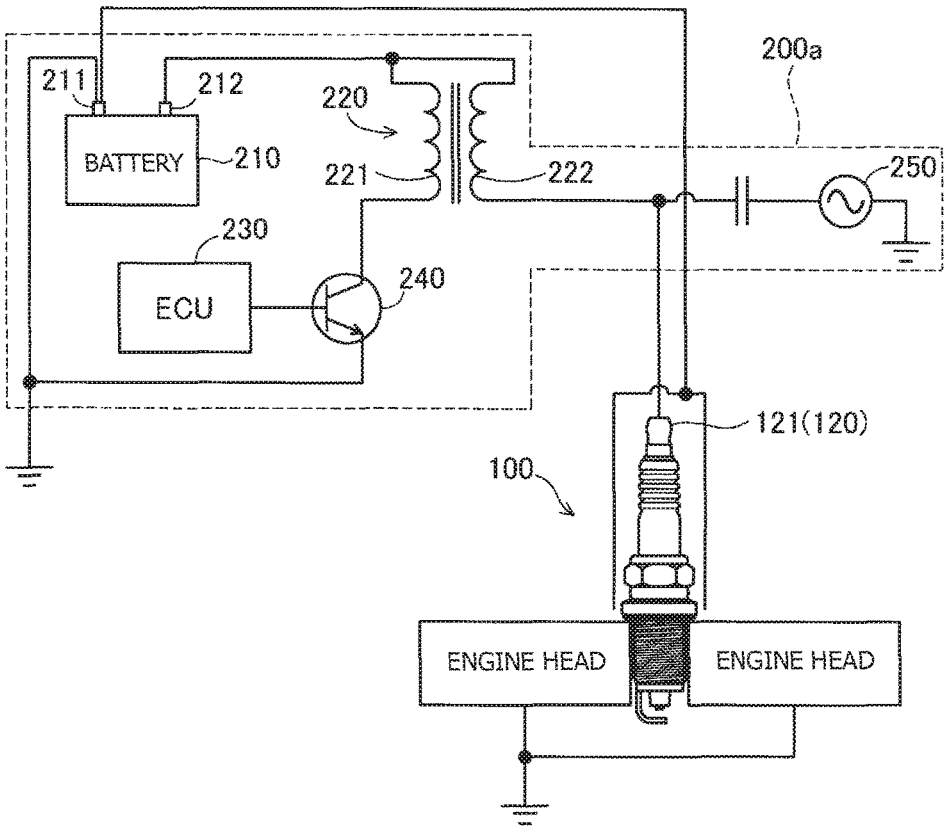
FIG. 17 is a diagram showing a schematic configuration of a power supply section used in the third evaluation test.

FIG. 17 is a diagram showing the schematic configuration of a power supply section 200*a* used in the third evaluation test. The power supply section 200*a* used in the present test includes an AC power source 250 for applying an AC power to the internal electrode 125. The AC power source 250, together with the ignition coil 220, is connected to the internal electrode 125 (the terminal 121) of the spark plug 100. In the present test, by use of the AC power source 250, during application of a discharge voltage by the ignition coil 220, a 1 A microwave having a frequency of 2.5 GHz was superposed on the discharge voltage for three milliseconds.

As shown in FIGS. 15 and 16, since the third evaluation test used the AC power source 250, even though the specifications of the spark plug 100 remained unchanged, the noise intensity of the comparative example increased from that in the second evaluation test. Specifically, the average noise intensity of the comparative example was about 40 db in the second evaluation test (FIG. 14), whereas the average noise intensity of the comparative example was about 45 db in the third evaluation test (FIG. 16). However, in spite of use of the AC power source 250, the noise intensities of the first and second embodiments in the third evaluation test (FIG. 16) were substantially similar to those in the second evaluation test (FIG. 14); specifically, the first embodiment exhibited about 29 db, and the second embodiment exhibited about 27 db. Thus, in the third evaluation test, the first embodiment and the second embodiment exhibited a percentage of noise reduction from the comparative example of about 36% and about 40%, respectively, which were better than about 27% (first embodiment) and 32% (second embodiment) in the second evaluation test. Therefore, it has been confirmed that, in the case of use of the no-resistance spark plug 100 and the AC power source 250, which is more likely to radiate noise, the ignition systems 10 and 10*b* of the first embodiment and the second embodiment, respectively, can more effectively restrain radiation of noise. The present test used the no-resistance spark plugs. However, even though a spark plug having a resistance is used, the noise reducing effect of the first embodiment and the second embodiment can be obtained. Therefore, the present invention can be similarly applied to an ignition system which includes a spark plugs having a resistance.

E. Modifications

<Modification 1>

In the above embodiments, the electrically conductive path 40 and the shield 60 are connected directly to the ground terminal 211 of the battery 210 through the cables 41 and 61, respectively. By contrast, the electrically conductive path 40 and the shield 60 may be connected to any position of the ground line in the power supply sections 200 and 200*a* to thereby be electrically connected to the ground terminal 211.

<Modification 2>

In the above embodiments, the electrically conductive path 40 and the shield 60 are formed of respective pipes of SUS. However, material for the electrically conductive path 40 and the shield 60 is not limited thereto. For example, other electrically conductive materials such as copper and silver may be used. Also, the material is not limited to a pipe-shaped material. For example, a mesh material may be used.

<Modification 3>

In the above third embodiment, the shield 60 surrounds the electrically conductive path 40. By contrast, for example, the shield 60 may be disposed inside the electrically conductive path 40.

<Modification 4>

The spark plug 100 in the above first to third embodiments may be a spark plug 100 having a resistance or a spark plug 100 having no resistance.

<Modification 5>

The power supply section 200*a* used in the above third evaluation test is applicable to not only the first embodiment and the second embodiment but also the third embodiment.

The present invention is not limited to the above embodiments and modifications, but may be embodied in various other forms without departing from the spirit of the invention. For example, in order to solve, partially or entirely, the above-mentioned problem or yield, partially or entirely, the above-mentioned effects, technical features of the embodiments and modifications corresponding to technical features of the modes described in the section "Summary of the Invention" can be replaced or combined as appropriate. Also, the technical feature(s) may be eliminated as appropriate unless the present specification mentions that the technical feature(s) is mandatory.

DESCRIPTION OF REFERENCE NUMERALS

10, 10*a*, 10*b*, 10*c*, 10*d*, 10*e*, 10*f*: ignition system
20, 20*a*, 20*b*, 20*c*, 20*d*, 20*e*, 20*f*: engine head
21, 21*a*, 21*b*, 21*c*, 21*d*, 21*e*: plug attachment hole
22, 22*d*: second insulator
23*a*, 23*c*, 23*e*: plug hole
30: plug cord
40: electrically conductive path
41: cable
45: insulation layer
46: insulation layer
47: insulation layer
60: shield
61: cable
70: coil boot
100: spark plug
110: first insulator
111: axial hole
120: center electrode
121: terminal
122: seal material
125: internal electrode
130: metallic shell
131: ground electrode
132: mounting threaded portion
200, 200*a*: power supply section
210: battery
211: ground terminal

212: power supply terminal
220: ignition coil
221: primary coil
222: secondary coil
230: electronic control unit
240: igniter
250: AC power source Having described the invention, the following is claimed:

1. An ignition system comprising:

a spark plug attached to an engine head;

a power supply section having a battery which has a ground terminal, and an ignition coil which transforms a voltage of the battery and supplies a transformed voltage to the spark plug, the spark plug including:

a first insulator having an axial hole, an internal electrode provided in the axial hole and having a terminal connected to the ignition coil, and a metallic shell disposed around an outer circumference of the first insulator, the metallic shell having a ground electrode, the metallic shell being fixed to the engine head through engagement with a second insulator embedded in the engine head, the metallic shell electrically insulated from the engine head by the second insulator; and an electrically conductive path connected to the metallic shell and the ground terminal, while being electrically insulated from the engine head.

2. An ignition system according to claim 1, further comprising:

a grounded electrically conductive shield which extends from a terminal side of the spark plug and surrounds at least a portion of the spark plug.

3. An ignition system according to claim 1, wherein the internal electrode has a resistance of 1Ω or less.

4. An ignition system according to claim 1, wherein the power supply section further comprises:

an AC power source for applying an AC power to the internal electrode.

5. An ignition system comprising:

a spark plug attached to an engine head;

a power supply section having a battery which has a ground terminal, and an ignition coil which transforms a voltage of the battery and supplies a transformed voltage to the spark plug, the spark plug including:

a first insulator having an axial hole, an internal electrode provided in the axial hole and having a terminal connected to the ignition coil, and a metallic shell disposed around an outer circumference of the first insulator, having a ground electrode, and fixed to the engine head, an electrically conductive shield which extends from a terminal side of the spark plug and surrounds at least a portion of the spark plug, wherein the shield surrounds at least a portion of the first insulator, is spaced from contact with the spark plug, and is electrically connected to the ground terminal while being electrically insulated from the engine head.

6. An ignition system according to claim 5, wherein the internal electrode has a resistance of 1Ω or less.

7. An ignition system according to claim 5, wherein the power supply section further comprises:

an AC power source for applying an AC power to the internal electrode.

* * * * *